US011725475B2

(12) United States Patent
Qureshi

(10) Patent No.: US 11,725,475 B2
(45) Date of Patent: Aug. 15, 2023

(54) DRILL PIPE CONVEYED PERMANENT BRIDGE PLUG WITH INTEGRAL CASING SCRAPER

(71) Applicant: SAUDI ARABIAN OIL COMPANY, Dhahran (SA)

(72) Inventor: Muhammad Ali Qureshi, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 99 days.

(21) Appl. No.: 17/209,863

(22) Filed: Mar. 23, 2021

(65) Prior Publication Data

US 2022/0307344 A1 Sep. 29, 2022

(51) Int. Cl.
*E21B 33/16* (2006.01)
*E21B 37/02* (2006.01)

(52) U.S. Cl.
CPC ..... *E21B 33/16* (2013.01); *E21B 37/02* (2013.01)

(58) Field of Classification Search
CPC ..... E21B 33/16; E21B 37/02
See application file for complete search history.

(56) References Cited

U.S. PATENT DOCUMENTS 3,409,085 A * 11/1968 Oliver ..... E21B 33/1292 166/134
5,839,511 A * 11/1998 Williams ..... E21B 37/00 166/312
6,460,617 B1 * 10/2002 Allen ..... E21B 33/1204 166/173
2001/0042623 A1 11/2001 Reynolds
2010/0032154 A1 2/2010 Gillan
2016/0237764 A1 * 8/2016 Jellison ..... E21B 17/042
2019/0063177 A1 * 2/2019 Schmidt ..... E21B 33/1208
2020/0332625 A1 * 10/2020 Howitt ..... E21B 37/02

* cited by examiner

*Primary Examiner* — Tara Schimpf
*Assistant Examiner* — Yanick A Akaragwe
(74) *Attorney, Agent, or Firm* — Osha Bergman Watanabe & Burton LLP

(57) ABSTRACT

An integral permanent bridge plug assembly for a wellbore. The integral permanent bridge plug assembly includes a permanent bridge plug mounted to a cylindrical body, a setting sleeve, a bottom connection, an engagement assembly mounted to an outer diameter of the cylindrical body that is selectively extendible between a recessed position and an extended position, and a scraper including a plurality of blades and configured to engage the wellbore tubular in which the permanent bridge plug is to be set. The wellbore has a wellbore tubular having an internal diameter surface. When deployed, the integral permanent bridge plug assembly is configured to both scrape the internal diameter surface of the wellbore tubular and set an isolation barrier in a single trip into the wellbore.

20 Claims, 4 Drawing Sheets

DRILL PIPE CONVEYED PERMANENT BRIDGE PLUG WITH INTEGRAL CASING SCRAPER

BACKGROUND

Hydrocarbon resources are typically located below the earth's surface in subterranean porous rock formations, often called reservoirs. These hydrocarbon bearing reservoirs can be found in depths of tens of thousands of feet below the surface. In order to extract the hydrocarbon fluids, also referred to as oil and/or gas, wells may be drilled to gain access to the reservoirs. Wells may be drilled vertically from surface, deviated from vertical, or vertical to horizontal in order to most effectively and efficiently access the subsurface hydrocarbon reservoirs.

A step in the drilling operations, or well construction, involves casing the wellbore with tubulars and cementing the tubulars in place. This isolates the internal conduit or well from the surrounding formations, which may be prone to collapse or have undesirable hazards present such as shallow gas. Each section of the well is typically drilled with a drill bit that is attached to a length of drill string that extends from the bottom of the wellbore to the drilling rig at surface. Upon the completion of drilling a section of well bore, the drilling string and drill bit are pulled out of the wellbore and a section of casing is deployed into the wellbore, which will be cemented into place creating the desired isolation from the newly drilled formation.

Once the well construction is complete, sections of the wellbore are isolated, including a scenario where there exists multiple producing formations and the preference is to produce each formation independently. A current solution for isolating sections of the wellbore is the deployment of a permanent bridge plug (PBP). The PBP is a mechanical device that is deployed into a wellbore and anchored to the casing a planned setting depth. The PBP acts as a plug and prevents fluid flow across the device creating an isolation barrier within the wellbore.

The PBP may also be used in other instances including to install a permanent barrier in addition to the already existing cemented casing in the wellbore in order to have redundancy. Another application may be when a well has been depleted of hydrocarbon reserves and production is no longer economically viable. In such a scenario, a PBP and cement plugs may be placed above the producing interval to create an effective seal for permanently abandoning the well. This prevents hydrocarbons from inadvertently finding their way to surface and creating a hazardous situation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to an integral permanent bridge plug assembly for a wellbore. The integral permanent bridge plug assembly includes both a permanent bridge plug and a scrapper. The permanent bridge plug includes a cylindrical body, a setting sleeve, a bottom connection, and an engagement assembly mounted to an outer diameter of the cylindrical body that is selectively extendible between a recessed position and an extended position. The scraper includes a plurality of blades and is configured to engage the permanent bridge plug. When deployed inside the inner diameter of the wellbore tubular, the integral permanent bridge plug assembly is configured to both scrape the internal diameter surface of the wellbore tubular and set an isolation barrier in a single trip into the wellbore.

In one or more embodiments, the present disclosure relates to a method of setting an isolation barrier inside a wellbore. In this scenario, a scraper is integrally fit to a PBP creating a PBP assembly. While the casing remains in the wellbore, the PBP assembly is deployed into the wellbore on the drill string inside the internal diameter of the wellbore tubular. As the PBP is conveyed downhole in the wellbore, the scrapper contacts the inside surface of the wellbore tubular and begins the scrapping operations. Fluid circulation commences and the PBP assembly is reciprocated across the setting area for at least three cycles, which scrapes and flushes the setting area free of debris. After the setting area is cleaned, the lower slips of the engagement assembly are activated by applying a right-hand rotation and weight down on the setting sleeve via the drill string. Next the packer element and upper slips of the engagement assembly are activated by applying an upward force on the setting sleeve anchoring the PBP assembly in place and creating the desired isolation barrier. The setting sleeve and drill string are release and pulled out of the wellbore to surface leaving the PBP and scraper in the wellbore permanently.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to an integral permanent bridge plug (PBP) assembly with a scraper which saves time and cost to the operator by eliminating two separate trips down the casing. Current scraper designs are typically constructed from high quality material in order to withstand repeated use with minimal maintenance or redressing, which is more costly and would not be advantageous to leave in the wellbore after a single use. In contrast, the disclosed combined scraper and PBP may be constructed from a lower quality material as it will not be recovered for repeated use, thus reducing the scraper cost. In such case, the time and associated cost of the lower quality sacrificial scraper will be offset advantageously by cost savings associated with operational time saved by performing the scraper and bridge plug operation in a single trip into the wellbore.

A scraper run is mandatory before running and setting a permanent bridge plug (PBP) in order to clean the casing at the depth where the PBP will be set. If the scraper run is omitted the PBP packer element may not make an effective seal against the host casing due to presence of scale, rust, wax, mud cake, or similar debris on the walls of the casing that may prevent the element rubber from fully contacting and compressing against it. In cases where the PBP is to be run and deployed using the drill string, for example in highly deviated wells where wireline conveyance is not possible, the integral scraper and plug assembly disclosed herein may be run and scrape the setting area before activating the setting mechanism to deploy the bridge plug. The setting tool is then recovered leaving behind the PBP and scraper in the hole.

Figure 1:
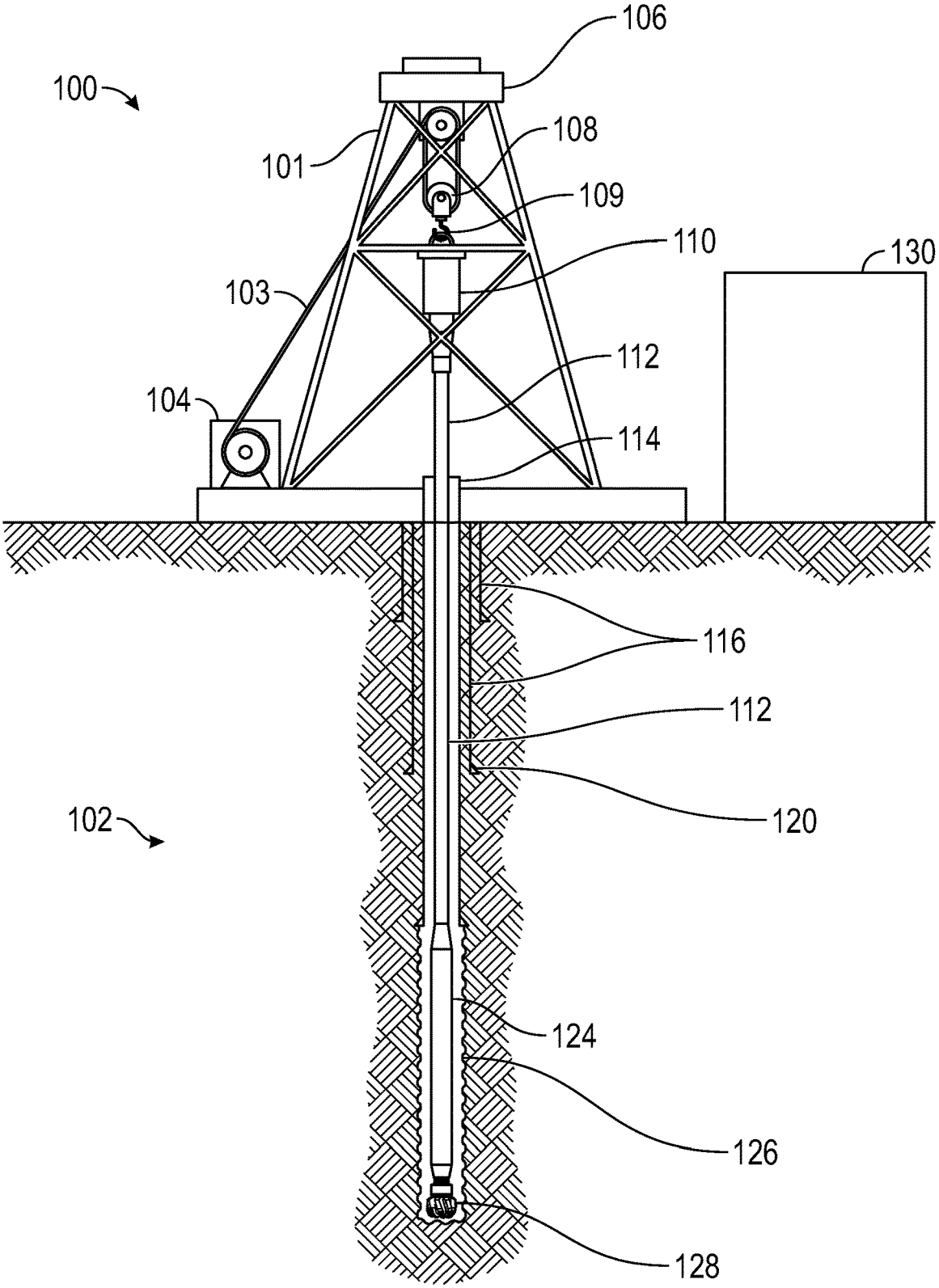
FIG. 1 illustrates a drilling rig and wellbore in accordance with one or more embodiments disclosed herein.

FIG. 1 illustrates an exemplary well site (100). In general, well sites may be configured in a myriad of ways. Therefore, the well site (100) is not intended to be limited with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (126). For the purpose of drilling a new section of wellbore (102), a drill string (112) is suspended within the wellbore (102). The drill string (112) may include one or more drill pipes connected to form conduit and a bottom hole assembly (BHA) (124) disposed at the distal end of the conduit. The BHA (124) may include a drill bit (128) to cut into the subsurface rock. The BHA (124) may include measurement tools, such as measurement-while-drilling (MWD) tool and logging-while-drilling (LWD) tool (not shown), as well as other drilling tools that are not specifically shown.

The drill string (112) may be suspended in wellbore (102) by a derrick structure (101). A crown block (106) may be mounted at the top of the derrick structure (101), and a traveling block (108) may hang down from the crown block (106) by means of a cable or drill line (103). One end of the drill line (103) may be connected to a drawworks (104), which is a reeling device that can be used to adjust the length of the cable (103) so that the traveling block (108) may move up or down the derrick structure (101). The traveling block (108) may include a hook (109) on which a top drive (110) is supported. The top drive (110) is coupled to the top of the drill string (112) and is operable to rotate the drill string (112). Alternatively, the drill string (112) may be rotated by means of a rotary table (not shown) on the surface (114). Drilling fluid (commonly called mud) (not shown) may be pumped from the mud system (130) into the drill string (112). The mud may flow into the drill string (112) through appropriate flow paths in the top drive (110) (or a rotary swivel if a rotary table is used instead of a top drive to rotate the drill string (not shown)).

During a drilling operation at the well site (100), the drill string (112) is rotated relative to the wellbore (102), and weight is applied to the drill bit (128) to enable the drill bit (128) to break rock as the drill string (112) is rotated. In some cases, the drill bit (128) may be rotated independently with a drilling motor (not shown). In further embodiments, the drill bit (128) may be rotated using a combination of the drilling motor (not shown) and the top drive (110) (or a rotary swivel if a rotary table is used instead of a top drive to rotate the drill string (112). While cutting rock with the drill bit (128), mud (not shown) is pumped into the drill string (112). The mud flows down the drill string (112) and exits into the bottom of the wellbore (102) through nozzles in the drill bit (128). The mud in the wellbore (102) then flows back up to the surface (114) in an annular space between the drill string (112) and the wellbore (102) with entrained cuttings (not shown). The mud with the cuttings is returned to the mud system (130) to be circulated back again into the drill string (112). Typically, the cuttings are removed from the mud, and the mud is reconditioned as necessary, before pumping the mud again into the drill string (112).

Post drilling operations, when the drill string (112), the BHA (124), and the drill bit (128) have been removed from the wellbore (102), in some embodiments of wellbore (102) construction, the production casing operations may commence. A casing string (116), which is made up of one or more lager diameter tubulars that have a larger outer diameter than the drill string (112) but a smaller outer diameter than the wellbore (102), are lowered into the wellbore (102) on the drill string (112). In some embodiments, the casing string (116) is designed to isolate the internal diameter of the wellbore (102) from the adjacent formation (126). Once the casing string (116) is in position, it is set and cement is pumped down through the internal space of the casing string (116), out of the bottom of the casing shoe (120), and fills the annular space between the wellbore (102) and the outer diameter of the casing string (116). This secures the casing string (116) in place and creates the desired isolation between the wellbore (102) and the formation (126). At this point, drilling of the next section of the wellbore (102) may commence.

Figure 2:
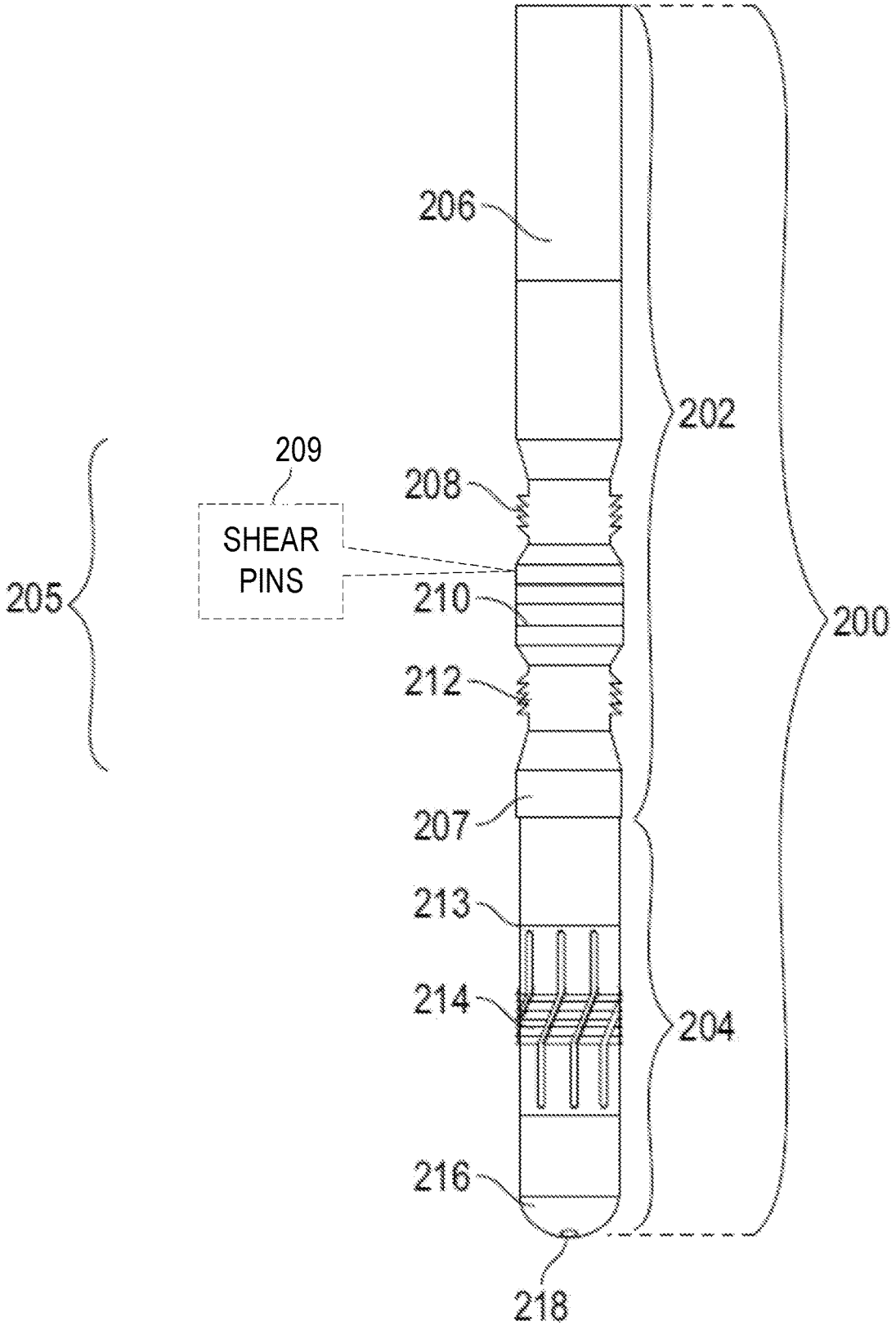
FIG. 2 is a schematic showing integral permanent bridge plug assembly in accordance with one or more embodiments.

FIG. 2 depicts, in one or more embodiments, the integral permanent bridge plug (PBP) assembly (200). The integral permanent bridge plug assembly (200) is configured to anchor to the inside of the casing string (116) of the wellbore (102) and includes both a permanent bridge plug (PBP) (202) and a scraper (204). More specifically, the integral PBP assembly includes a disposable casing scraper installed below a PBP (202). When set, the integral permanent bridge plug assembly (200) creates an isolation barrier in the well below the integral permanent bridge plug assembly (200). As the barrier is permanent, when the drill string (112) is disconnected from the integral permanent bridge plug assembly (200) both the PBP (202) and scraper (204) remain inside the wellbore (102).

In one or more embodiments, the PBP (202) further includes a setting sleeve (206) and an engagement assembly (205). The setting sleeve (206) is located at the top of the PBP (202) and is configured to attach to the drill string (112) during deployment. In addition, the setting sleeve (206) is used to selectively operate the engagement assembly (205). The engagement assembly (205) is located on the outside diameter of the cylindrically shaped PBP (202) and has upper slips (208), a packer element (210), and lower slips (212). In one or more embodiments, the upper slips (208) and the lower slips (212) have ridges that, when shifted to the extended position by the setting sleeve (206), grip the inside of the casing string (116) anchoring the PBP (202) to the casing string (116). A gauge ring (not shown) is provided above and below the slips (208, 212) to protect any wear from occurring when running in hole or when scraping the setting area. The packer element (210), which is made of an elastomeric material or equivalent, is also activated by the setting sleeve (206). When shifted into the extended position, the packer element (210) applies a radial outward force that seals against the inside of the casing string (116), creating an isolation barrier and isolating the wellbore below the PBP (202).

The scraper (204), which is attached to the lower end of the PBP (202) by the PBP bottom connection (207), includes a plurality of blades (214), a cylindrical body (213), a bull-nosed shaped end (216), and a circulation port (218) within the bull-nosed shaped end (216). In one or more embodiments, the scraper (204) is configured to be of a slightly larger diameter that the PBP (202) when the PBP (202) is in the recessed position. This prevents undesirable wear on the PBP (202) during scraping operations. In one or more embodiments, the scraper and plug may be fabricated in any required size e.g., for 9⅝" casing, 7", and 4½" liners.

The plurality of blades (214) are located on the outer diameter of the cylindrical body (213) of the scraper (204). The blades (214) are knife-like, non-rotating, spring loaded, and oriented downward in an overlapping spiral arrangement. This orientation ensures that there is a continuous circumferential contact between the blades (214) and the area of the casing string (116) that is to be scraped. Further, the blades (214) conform to the internal diameter of the casing or liner depending upon the weight of casing. The scraper (204) and attached blades (214) form a lantern-like shape which compresses upon entering the casing string (116) that is to be scraped. The compression of the scraper (204) ensures effective contact of the blades (214) against the internal surface of the casing string (116). The scraping commences as soon as the scarper (204) enters the target casing (116). However, emphasis is placed on the PBP (202) setting area by reciprocating the scraper across this depth at least three times while circulating through the drill string (112). This ensures that the PBP (202) setting area is clear of debris and ready to host the PBP (202).

In one or more embodiments, the bull-nosed shaped end (216) of the scraper guides the integral permanent bridge plug assembly (200) as it is being deployed in hole, centering the integral permanent bridge plug assembly (200) in the wellbore (102). The bull-nosed shaped end (216) assists in navigating through tight spots or ledges that may be present, so that the assembly (200) does not get held up on a liner top or any sharp shoulder in the wellbore (102).

The circulation port (218), which is located on the bottom of the bull-nosed shaped end (216) of the scraper (204), is at least a single circular shaped port that may vary in diameter based on the size of the integral permanent bridge plug assembly (200) that is deployed. Those skilled in the art will appreciate that the bull-nosed shaped end (216) of the scraper may include more than one port without departing from the scope herein.

Figure 3:
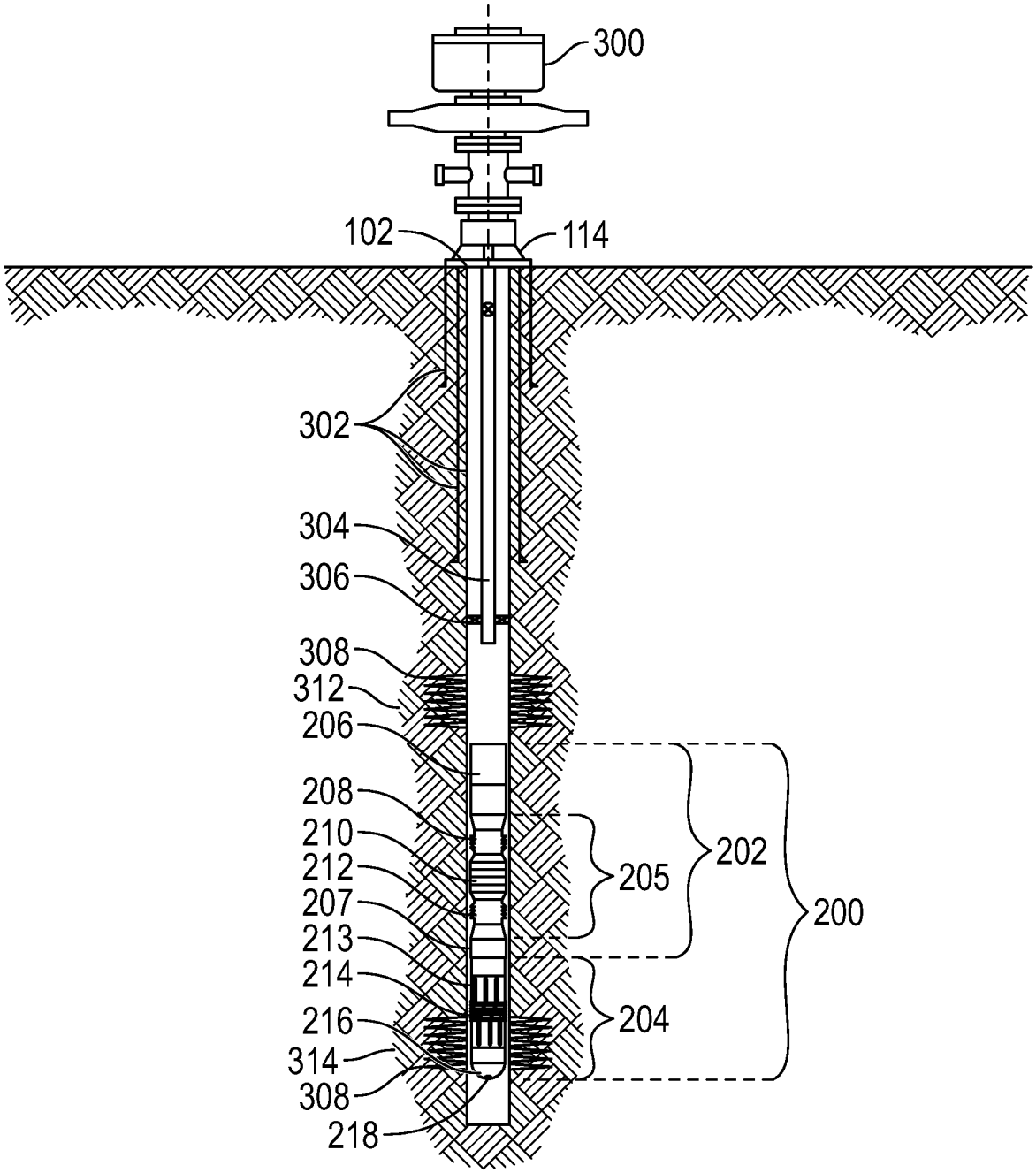
FIG. 3 is a schematic showing integral permanent bridge plug assembly deployed in a wellbore in accordance with one or more embodiments.

FIG. 3 depicts, in one or more embodiments, the integral permanent bridge plug assembly (200) deployed in a hydrocarbon producing wellbore (102). As shown, in addition to the casing (302), the wellhead (300), production tubing (304) and production packer (306) are installed in the wellbore (102).

In one or more embodiments, there may be at least two hydrocarbon producing reservoirs (not shown), in which it may be desirable to produce the hydrocarbons from each of the upper reservoir (312) and lower reservoir (314) independently. Before the integral permanent bridge plug assembly (200) is installed, to achieve this independent hydrocarbon production, typically the lower reservoir (314) is perforated with a perforating gun (not shown) resulting in large fractures or perforations (308) extending laterally into the lower reservoir (314). This creates a pathway for the hydrocarbons to flow from the pores (not shown) in the lower reservoir (314) into the wellbore (102), through the production tubing (304), into the wellhead (300), and associated flowlines (not shown) at surface (114). Depending on the capacity and pressure of the lower reservoir (314), after some duration the hydrocarbon production will see a reduction in flow rates or an increase in water cut. At this stage, it may be desirable to isolate the lower reservoir (314) and begin producing from the upper reservoir (312). In one or embodiments, one of ordinary skill in the art would appreciate that this operation will require pulling and installing new production tubing (304).

The upper reservoir (312), in one or more embodiments, is isolated from the lower reservoir (314) by deploying and setting the integral permanent bridge plug assembly (200) in the wellbore (102) at a setting depth between the lower reservoir (314) and the upper reservoir (312). This creates an isolation barrier in the wellbore (102) below the PBP (202).

The integral permanent bridge plug assembly (200), consisting of the PBP (202) and the scraper (204), is assembled at surface (114) with the scraper (204) being oriented below the PBP (202). The integral permanent bridge plug assembly (200) is shown as deployed and set at the planned setting depth above the lower reservoir (512).

As depicted in FIG. 3, the lower slips (212) and upper slips (208) are in the extended position and grip the internal diameter of the casing (302). Thus, the engagement assembly (205) of the PBP (202) is engaged and anchoring the PBP (202) to the casing (302). In addition, the packer element (210) is shown in the extended or expanded position and is applying a radial outward force against the internal diameter of the casing (302) creating a seal between the packer element (210) and the internal diameter of the casing (302). This configuration creates a fluid flow and pressure isolation of the section of wellbore (102) below the PBP (202). The PBP (202) and scraper are permanent installations and will remain in this position in the wellbore (102) until such a time the well is abandon or an invention operation is conducted to modify the wellbore (102) as shown.

During deployment and before the setting of the PBP (202), the internal surface of the casing (302) at the setting depth is scraped and fluid circulated to clear the area of debris, scale, mud cake, and other material that may impact the seal-ability of the packer element (210). The scraper (204), which is connected immediately below the PBP (202), performs this function through the circumferential contact of the blades (214) combined with the downward motion of the drill string (112) and the fluid circulation through the circulation port (218). Multiple repetitions of scraping and fluid circulation across the setting area may be required to ensure adequate cleaning of the internal diameter of the casing (302). When the integral permanent bridge plug assembly (200) is set in the wellbore (102), both the PBP (202) and the scraper (204) remain in the wellbore (102) permanently.

Figure 4:
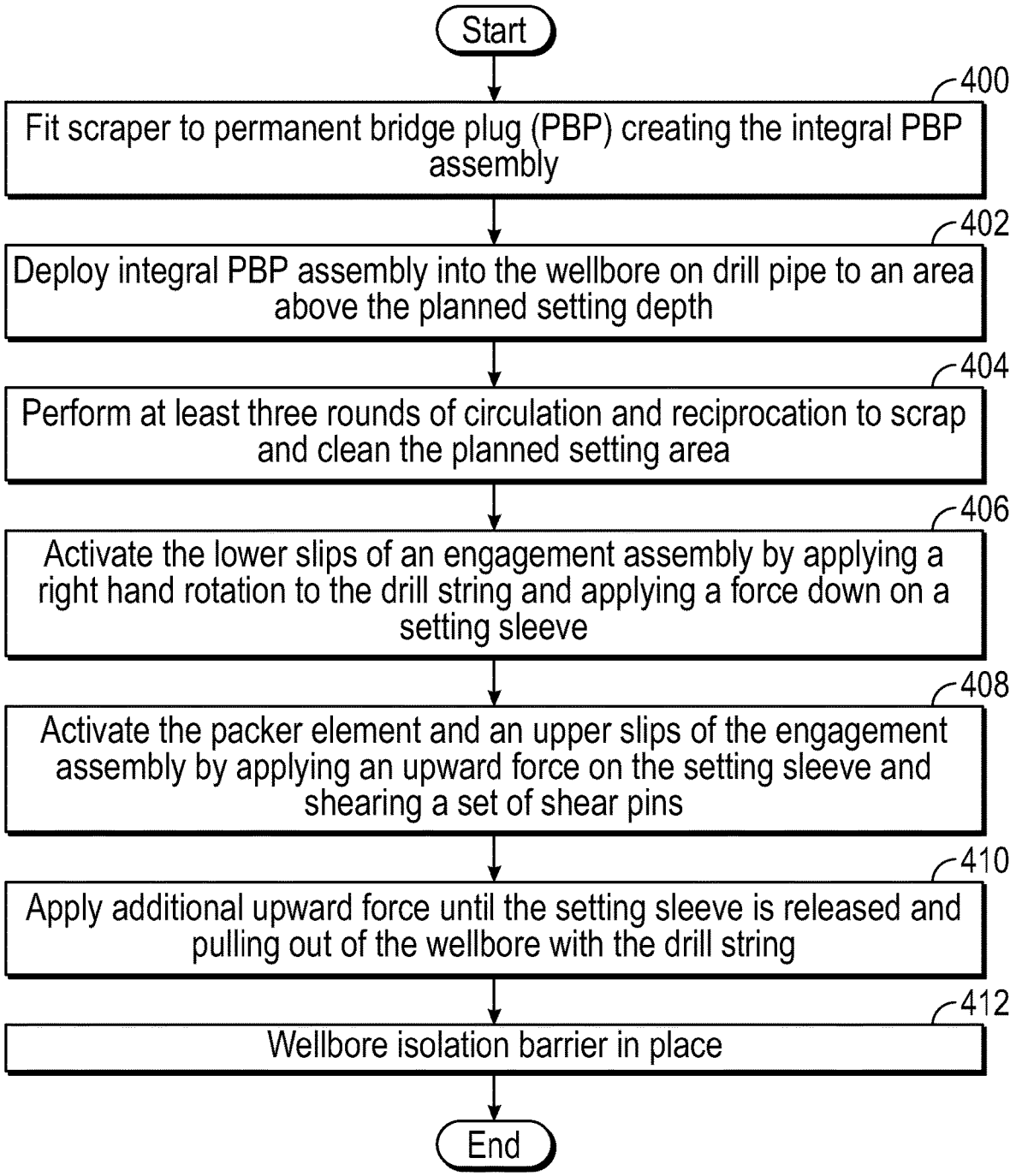
FIG. 4 is a flowchart in accordance with one or more embodiments.

FIG. 4 is a flowchart depicting, in one or more embodiments, the operational sequence for the installation of an integral permanent bridge plug assembly (200) in a wellbore (102). One or more blocks in FIG. 4 may be performed using one or more components as described in FIGS. 1 through 3. While the various blocks in FIG. 4 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

In Step 400, the PBP (202) and the scraper (204) are fitted via the PBP bottom connection (207) at surface (114) creating the integral permanent bridge plug assembly (200). The PBP bottom connection (207) may be threaded connection or equivalent connection that one of ordinary skill in the art would appreciate.

In Step 402, the integral permanent bridge plug assembly (200) is deployed into the wellbore (102) inside the casing (302) on the drill string (112) to an area above the planned setting depth.

In Step 404, in accordance with one or more embodiments, as the drill string (112) is continually lowered and the scraper (204) enters the casing (302) that is to be scraped, the blades (214) make contact with the internal diameter of the casing (302) and begin scraping the casing (302) free of debris, scale, mud cake, or other material that may be present. Upon reaching the setting depth of the PBP (202), circulation through the circulation port (218) commences and the drill string (112) is reciprocated up and down at least 20 feet in either direction, and is repeated at least three times. Due to the downward orientation of the blades (214), the primary scraping action occurs when the drill string (112) is moving downward. In addition, fluid circulation is conducted by pumping fluid down the drill string (112), the fluid exits the circulation port (218) of the scraper (204) and moves upward in the annular space between the drill string (112) and the casing (320). The removed debris is washed up with the fluid being circulated from below the scraper (204). As the fluid flows across the blades (214), the scraped debris becomes entrained and is carried up the annulus all the way to surface (114) and out of the wellbore (102).

In Step 406, in accordance with one or more embodiments, the PBP (202), and thus the integral permanent bridge plug assembly (200), is set by applying right hand rotation and then setting down weight on the PBP (202) by the drill string (112) to shift the lower slips (212) to the extended position griping in internal diameter of the casing (302).

In Step 408, in accordance with one or more embodiments, an upward force is applied to the setting sleeve (206) by the drill string (112) which shears a set of shear pins (209) on the packer element (210) and upper slips (208). As the setting sleeve (206) moves upwards, the packer element (210) is extended and pushed against the internal diameter of the casing (302) and the upper slips (208) are shifted to the extended position griping the internal diameter of the casing (302). The integral permanent bridge plug assembly (200) is now anchored to the internal diameter of the casing (302).

In Step 410, additional upward tension is applied on the setting sleeve (206) by the drill string (416) collapsing the retrieval busing (not shown) releasing drill string (112) from the setting sleeve (206). In one or more embodiments, the scraper is sacrificial and left in hole, below the PBP. The drill string (112) is picked up to a position above the integral permanent bridge plug assembly (200) and integrity pressure testing commences before the drill string (112) is pulled completely out of the wellbore (102) leaving the PBP (202) and connected scraper (204) in the wellbore (102) permanently.

In Step 412, the integral permanent bridge plug assembly (200) has created the desired isolation barrier within the wellbore (102). Operations to perforate and produce the upper reservoir (312) may be commenced thereafter.

Embodiments of the present disclosure may provide at least one of the following advantages including time saving, and associated cost related to rig time, by eliminating a dedicated trip into the wellbore (102) for scraper (204) operations. By combining the PBP (202) setting operations and the scraper (204) operations into a single trip into the wellbore (102) the amount of rig time require is reduced, which results in a reduction in cost associated with rig time.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. An integral permanent bridge plug assembly for a wellbore, comprising:

a permanent bridge plug comprising a cylindrical body, a setting sleeve, and a bottom connection;

an engagement assembly mounted to an outer diameter of the cylindrical body and selectively extendible between a recessed position and an extended position;

the engagement assembly comprising upper slips and lower slips;

a scraper comprising a plurality of blades configured to connect to the bottom connection of the permanent bridge plug; and wherein the wellbore comprises a wellbore tubular, having an internal diameter surface, wherein the integral permanent bridge plug assembly is deployed on a drill string, wherein when deployed, the integral permanent bridge plug assembly is configured to both scrape the internal diameter surface of the wellbore tubular and set an isolation barrier in a single trip into the wellbore, wherein the lower slips are activated via applying a force down on the setting sleeve, and wherein the upper slips are activated by applying an upward force on the setting sleeve.

2. The integral permanent bridge plug assembly of claim 1, wherein:

when the isolation barrier is set, the permanent bridge plug and the scraper remain in the wellbore.

3. The integral permanent bridge plug assembly of claim 1, wherein:

when at a setting depth, the setting sleeve shifts the engagement assembly to the extended position anchoring the permanent bridge plug to the internal diameter surface of the wellbore tubular creating the isolation barrier.

4. The integral permanent bridge plug assembly of claim 1, wherein:

the engagement assembly comprises at least one packer element; and the at least one packer element is also activated via applying the upward force on the setting sleeve.

5. The integral permanent bridge plug assembly of claim 4, wherein the setting sleeve is released via applying an additional upward force thereto.

6. The integral permanent bridge plug assembly of claim 1, wherein:

a set of springs are attached to the plurality of blades;

wherein the set of springs create a spring-loaded force that provide continuous and full circumferential contact between the plurality of blades and the internal diameter surface of the wellbore tubular.

7. The integral permanent bridge plug assembly of claim 1, wherein:

the plurality of blades are fixed.

8. The integral permanent bridge plug assembly of claim 1, wherein:

wherein the plurality of blades are pointed at a downward angle and have a spiral orientation.

9. The integral permanent bridge plug assembly of claim 1, wherein:

the scraper has a bull-nosed shaped end.

10. The scraper of claim 9, wherein:

the bull-nosed shaped end has at least one circulation port facilitating circulation of fluid into the wellbore.

11. The integral permanent bridge plug assembly of claim 1, wherein:

the setting sleeve is disposed at a top end of the PBP and configured to selectively operate the engagement assembly.

12. The integral permanent bridge plug assembly of claim 1, wherein:

the permanent bridge plug and the scraper of the integral PBP assembly have a smaller outer diameter than an internal diameter of the wellbore tubular.

13. The integral permanent bridge plug assembly of claim 1, wherein:

the wellbore tubular is at least one of a casing or casing liner.

14. The integral permanent bridge plug assembly of claim 1, wherein:

the permanent bridge plug and the scraper are customizable to fit an array of sizes of the wellbore tubular.

15. A method of setting an isolation barrier in a wellbore in a single trip, comprising:

fitting a scraper integrally to a permanent bridge plug, creating a permanent bridge plug assembly;

deploying the permanent bridge plug assembly into the wellbore on a drill string inside an internal diameter of a wellbore tubular;

scraping an internal diameter surface of the wellbore tubular as the permanent bridge plug assembly is conveyed downhole in the wellbore;

circulating fluid and reciprocating a drill string up and down across a setting area at depth inside the wellbore tubular;

activating lower slips of an engagement assembly by applying a right hand rotation to the drill string and applying a force down on a setting sleeve;

activating a packer element and upper slips of the engagement assembly by applying an upward force on the setting sleeve and shearing a set of shear pins; and applying additional upward force until the setting sleeve is released and pulling the setting sleeve out of the wellbore with the drill string.

16. The method of claim 15, wherein:

scraping and fluid circulation operations are repeated at least three times.

17. The method of claim 15, wherein:

the fluid used for circulation is one of an oil-based fluid or a water-based fluid.

18. The method of claim 15, wherein:

fluid circulation carries debris away from the scraper and out of the wellbore.

19. The method of claim 15, wherein:

the scraper is fit to the PBP by a threaded connection.

20. The method of claim 15, wherein:

the upward force applied to the setting sleeve shears at least one of a shear pin.

* * * * *